US006087923A

United States Patent [19]

Ahn et al.

[11] Patent Number: 6,087,923

[45] Date of Patent: Jul. 11, 2000

[54] LOW CAPACITANCE CHIP VARISTOR AND FABRICATION METHOD THEREOF

[75] Inventors: Byeung Joon Ahn, Seoul; Yong Joo Kim, Suwon, both of Rep. of Korea

[73] Assignee: Ceratech Corporation, Rep. of Korea

[21] Appl. No.: 09/040,489

[22] Filed: Mar. 18, 1998

[30] Foreign Application Priority Data

Mar. 20, 1997 [KR] Rep. of Korea ..... 9529-1997
Aug. 19, 1997 [KR] Rep. of Korea ..... 39408-1997

[51] Int. Cl.[7] ..... H01L 7/10

[52] U.S. Cl. ..... 338/21; 338/260; 338/295; 338/313; 338/332

[58] Field of Search ..... 338/13, 20, 21, 338/226, 239, 260, 295, 313, 319, 320, 332

[56] References Cited

U.S. PATENT DOCUMENTS

| | | | |
|---|---|---|---|
| 5,115,221 | 5/1992 | Cowman | 338/21 |
| 5,119,062 | 6/1992 | Nakamura et al. | 338/20 |
| 5,235,310 | 8/1993 | Cowman et al. | 338/21 |
| 5,412,357 | 5/1995 | Nakamura et al. | 333/181 |
| 5,565,838 | 10/1996 | Chan | 338/21 |
| 5,757,263 | 5/1998 | Ravindranathan . | |

FOREIGN PATENT DOCUMENTS

| | | | |
|---|---|---|---|
| 60-702 | 4/1985 | Japan | 338/21 |
| 5-6806 | 1/1993 | Japan | 338/21 |

*Primary Examiner*—Karl Easthom
*Attorney, Agent, or Firm*—Ostrolenk, Faber, Gerb & Soffen, LLP

[57] ABSTRACT

A low capacitance chip varistor and a fabrication method thereof are described, which are capable of protecting the electronic elements of an electronic instrument from an external and internal surge and being well applicable to an electronic element which requires a low capacitance, and the low capacitance chip varistor includes at least one sheet support layer formed of a member having a low dielectric constant, a varistor layer including at least more than one varistor coating layer formed on the support layer, at least more than two internal electrode folded with a predetermined portion of the varistor layer to be connected with the varistor layer, one end of each of which is extended from a lateral surface of the support layer, and a pair of integrally formed external electrodes formed on a lateral surface of a varistor stack member integrally formed of the support layer, the varistor layer and the internal electrodes to be connected with one end portion of each internal electrode.

5 Claims, 5 Drawing Sheets

LOW CAPACITANCE CHIP VARISTOR AND FABRICATION METHOD THEREOF

BACKGROUND OF THE INVENTION

1. Field of the Invention

The present invention relates to a low capacitance chip varistor and a fabrication method thereof, and in particular to an improved low capacitance chip varistor and a fabrication method thereof which are capable of protecting the electronic elements of an electronic appliance from an external or internal surge and being well applicable to an electronic element which requires a low capacitance.

2. Description of the Conventional Art

Recently, as the electronic appliance is made lighter and compact in size and has multiple functions, a high density mounting technique is rapidly developed using a surface mounting device (SMD). Since a signal transmission speed of a surface-mounted device circuit exceeds MHZ unit, the capacitance should be lowered below 10 pF for enabling a high speed signal transmission and a faster operation of the circuit. More preferably, the signal transmission speed is required to be lowered below 5 pF.

In order to meet the above-described requirements, a disc type varistor is intensively studied as one of chip types. The chip varistors formed by stacking method have many problems to make low capacitance one since the material composing the same has high dielectric constant. Generally, since the chip varistor is made of materials having a high dielectric constant, if the area of both end portions contacting with an external electrode is larger, the capacitance is increased irrespective of the surface area of the internal electrode. Therefore, in order to decrease the capacitance, the varistor should be thinner for thereby decreasing the surface area of both end portions.

Generally, for allowing the capacitance of the varistor to be below 5 pF, the thickness of the varistor layer is formed to be below 1 mm. If the thickness of the varistor layer is below 1 mm, the varistor may be easily deformed or broken when sintering the same after stacking the varistors or when handling the same, so that it is impossible to fabricate a thinner varistor to meet a low capacitance requirement. Therefore, it is known that the stackable chip varistor can not have a capacitance below 1000 pF. Currently, the low capacitance chip varistor is not available in the industry. Therefore, a low capacitance chip varistor which has a low capacitance enough to be used for a high speed signal circuit and is not easily deformed and broken when fabricating and handling the same is desperately needed.

SUMMARY OF THE INVENTION

Accordingly, it is an object of the present invention to provide a chip varistor which has a low capacitance for being used for a high speed signal circuit wherein the chip varistor is not easily deformed and broken when fabricating and handling the same.

It is another object of the present invention to provide a fabrication method of aforementioned low capacitance chip varistor.

The above objects of the present invention are implemented by providing a chip varistor having a thinner varistor layer which has a lower capacitance for being used for a high speed signal circuit, and a supporting layer which has a strength and thickness for supporting the varistor layer on at least one surface of the same and has a low dielectric constant and does not affect a varistor characteristic of a varistor layer.

In the present invention, the low capacitance varistor includes the stacked body which is composed of the varistor layer formed of at least one varistor coating layer having a predetermined thickness which has a lower capacitance for being used for a high speed signal circuit, and the supporting layer having a lower dielectric constant and a predetermined strength and thickness for substantially supporting the varistor layer and at least more than two internal electrode formed on the varistor layer to be connected with each other through the varistor layer, and being integrally deposited and sintered on at least one surface of the varistor layer, and external electrodes formed on both lateral surfaces of the stacked body to be electrically connected with the internal electrode.

To achieve the above objects, in the present invention, the support layer is formed of a member which has a very low dielectric constant and does not affect the characteristic of the varistor and has a predetermined strength and thickness for protecting the varistor from an external impact when handling the same and is not easily deformed when sintering together with the varistor at a predetermined sintering temperature. More preferably, the support layer is formed of a ceramic material which has a very low dielectric constant. The ceramic support layer is formed to have a predetermined thickness enough to support the strength of the varistor layer. The above-described thickness of the ceramic support layer is more than 0.1 mm. The thickness of the support layer is determined based on the capacitance and the using condition. If necessary, the above-described conditions may be changed.

In the present invention, the thinner the thickness of the varistor layer, the better. Here, the thickness of the varistor layer is preferably below 1 mm, and more preferably, it is $1\mu$ to 1 mm. The varistor layer may be formed of a known varistor material such as ZnO, $BaTiO_3$, $SrTiO_3$, etc. In addition, the varistor layer may be made of one or two assistance materials such as $Bi_2O_3$, $Sb_2O_3$, $MnO_2$, $Co_2O_3$, $Ag_2O$, PbO, etc. together with the above-mentioned varistor material. The varistor material and assistance material may be independently used, or mixture of more than two kinds of the same may be used. However, as the varistor material and the assistance materials, other members which are generally used as the varistor materials and the assistance materials can be used.

The varistor layer may be formed on the whole surface of the ceramic support layer or may be partially formed on the surface of the ceramic sheet on which the internal electrode is formed. According to the latter construction, since the thickness of the same is thinner, and the exposed surface area is small, it is possible to obtain a chip varistor having a lower capacitance.

The internal electrode is formed to include at least two electrodes which are connected with the external electrode at both ends of the stacked body. In addition, the internal electrode may be formed on the surface of the varistor layer or on the surface of the support layer. The above-described two internal electrodes may be formed on the identical surface of the varistor layer or may be formed on both sides of the varistor layer. The internal electrodes are not directly connected but connected through the varistor layer.

At least one third internal electrode which is not connected with the external electrode may be connected through the varistor layer with two internal electrodes connected with the external electrode. In this case, the third internal electrode may be formed on the identical surface of the varistor layer, parallely from at least one of two internal electrodes and may be stacked together with at least one of two internal electrodes with respect to the varistor layer at both sides of the varistor layer.

In order to achieve the above objects, there is provided a method for fabricating a chip varistor according to the present invention which includes the steps of coating a paste or ink which is made of a varistor material on the surface of a support layer by a predetermined coating method such as a screen method, forming and dehydrating a first varistor coating layer, forming a first internal electrode on the surface of the varistor coating layer to be connected with an external electrode, forming a second internal electrode on the surface of the resultant structure to be connected with the coating layer and the external electrode, respectively, and stacking the varistor layer and/or support layer on the surface of the resultant structure for thereby forming a varistor stack member. Thereafter, an external electrode is formed on lateral surfaces of the stacked body in which the internal electrodes are exposed to be connected with the external electrodes, respectively, and the varistor coating layer is integrally sintered with the support layer.

In the present invention, the varistor coating later which forms the varistor layer is made by mixing 90~95 weight % of one selected from the group comprising ZnO, $BaTiO_3$, $SrTiO_3$ or more than two varistor main members selected from the above-described group with 5~10 weight % of one selected from the group comprising $Bi_2O_3$, $Sb_2O_3$, $MnO_2$, $Co_2O_3$, $Ag_2O$, and PbO or more than two varistor assistance materials selected from the above-described group, and then an organic binder of 3~8 weight % is added to the thusly fabricated compound based on the total weight of the compound, and a predetermined amount of the organic solvent is added thereto, so that the resultant compound is fabricated to a paste or ink state for the silk screen printing, and the coating is performed by a screen printing method.

In the present invention, as the organic binder, PVA, PVB, or ethlycellurous may be used. In addition, an alcohol group such as topinol, butylcapitol, methanol, ethanol, etc. may be used as the organic solvent. The above-described organic binder and organic solvent are disclosed only for examples. Namely, the above-described organic binder and organic solvent are not limited thereto.

In the present invention, the support layer is fabricated by adding the organic solvent to the powder of the ceramic material including a metallic oxide member which does not affect the characteristic of the varistor in spite of its lower dielectric constant and then is processed by the milling operation using a ball mill for uniformly mixing the resultant compounds for thereby coating to a predetermined thickness which is required for a synthetic resin film and dehydrating the same.

The internal electrode of the varistor may be formed by printing a slurry including an oxide member of Pt, Ag-Pt conductive metallic member by a silk screen printing method. The internal electrode may be formed in a band shape and may be linearly formed. At least one lateral surface of the stacked body is exposed so that the internal electrode is connected with the external electrode when cutting the sheet, in which the electrodes are formed, for fabricating small pieces of the stacked body for thereby fabricating a finished product of the chip varistor.

To achieve the above objects of the present invention, there is provided a chip varistor which includes a ceramic support layer, a varistor stack member including a varistor layer formed only on an inner portion of the surface of the support layer thereby preventing it from being laterally exposed from the support layer and at least two internal electrodes connected with an external electrode by the varistor layer, and an external electrode formed at both lateral surfaces of the stacked body for being connected with the internal electrodes.

In the above-described chip varistor, the varistor layer may be formed by coating the paste, which is the varistor material, on the surface of the flat support layer or may be formed on the surface of the varistor layer formed on the surface of the support layer. In addition, the varistor layer may be formed by forming a groove on the surface of the support layer and inserting the varistor paste into the groove by the casting method. The above-described varistor layer is formed to be connected with the end portions of two internal electrodes connected with the external electrode and not to be exposed from four lateral sides of the support member. The varistor layer may be formed between the lowest internal electrode and the surface of the support member.

In the above-described chip varistor, there are provided at least two internal electrodes, and a third internal electrode may not be connected with the external electrode, but if necessary, may be connected with the internal electrode through the varistor layer. The internal electrode connected with the external electrode is formed on the surface of the support member in a form of the coating layer, and the inner end portion of each internal electrode is formed to contact with the varistor layer for thereby connecting the internal electrodes with the varistor layer.

If the varistor layer is insertably formed in the groove of the support layer, it may be formed by the casting method. It is possible to decrease the thickness of the chip varistor due to the varistor layer by forming the varistor layer in the groove.

In the present invention, since the varistor layer is not laterally exposed from the portions in which the external electrodes are attached, it is possible to lower the capacitance of the capacitor to 5 pF, in particular, to below 3 pF.

In the chip varistor according to the present invention, since the varistor layer is formed by the coating method, the varistor layer is fabricated to be thinner, and since it is supported by the support layer which is formed of the ceramic sheet having a very lower dielectric constant, the varistor is not easily broken or damaged when forming or handling the same. In addition, since the area, related to the capacitance, of both lateral surfaces contacting with the external electrode is small, the capacitance is decreased.

In the present invention, since the capacitance of the varistor is decreased to 10 pF, in particular, to below 5 pF, the electric elements are effectively protected from an internal or external surge and it is possible to obtain an excellent varistor characteristic and to enable a high speed operation of the varistor.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
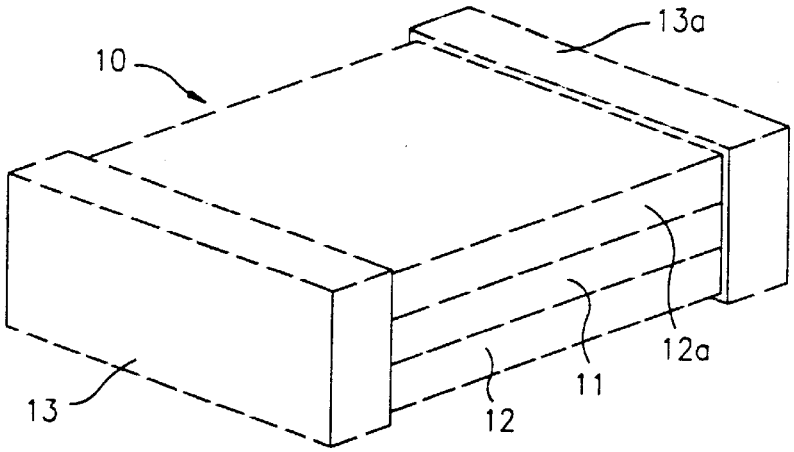
FIG. 1 is a perspective view illustrating a chip varistor according to an embodiment of the present invention.
Figure 2:
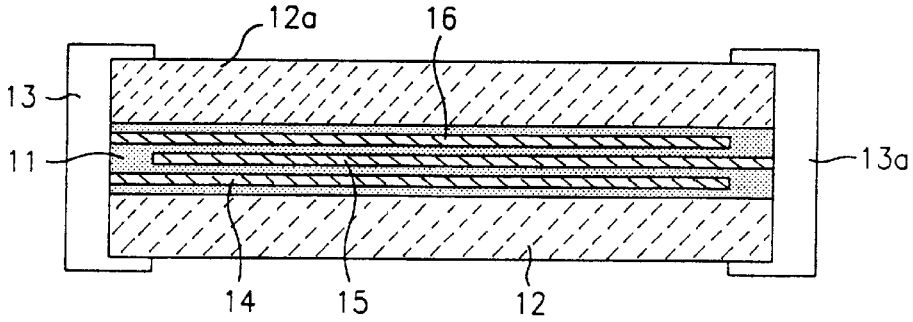
FIG. 2 is a vertical cross-sectional view illustrating the chip varistor of FIG. 1.
Figure 3:
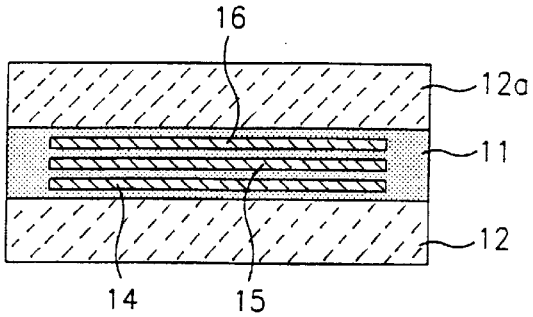
FIG. 3 is a horizontal cross-sectional view illustrating the chip varistor of FIG. 1.

FIGS. 1 through 3 are perspective views illustrating a chip varistor according to a first embodiment of the present invention. The chip varistor includes a stacked body 10 having a varistor layer 11, internal electrodes 14, 15 and 16, ceramic support layers 12 and 12*a* stacked on both surfaces of the varistor layer 11, and external electrodes 13 and 13*a* formed at both lateral surfaces of the stacked body 10 for being connected with the internal electrodes 14, 15 and 16. The above-described varistor layer 11 is integrally formed by sintering a plurality of varistor coating layers by a printing method. As shown in FIGS. 1 through 3, the varistor layer 11 is formed on the entire surface between the support layers 12 and 12*a*, and the outer circumferential surface of the same is laterally exposed from the lateral surface of the stacked body 10. In addition, end portions of the internal electrodes 14 and 16 are exposed from one lateral surface of the stacked body 10 and are connected with the external electrode 13, and the internal electrode 15 is exposed from another lateral surface of the stacked body 10 and is connected with the external electrode 13*a*. In the chip varistor according to the present invention, the varistor layer 11 is supported by the support layers 12 and 12*a*.

Figure 4:
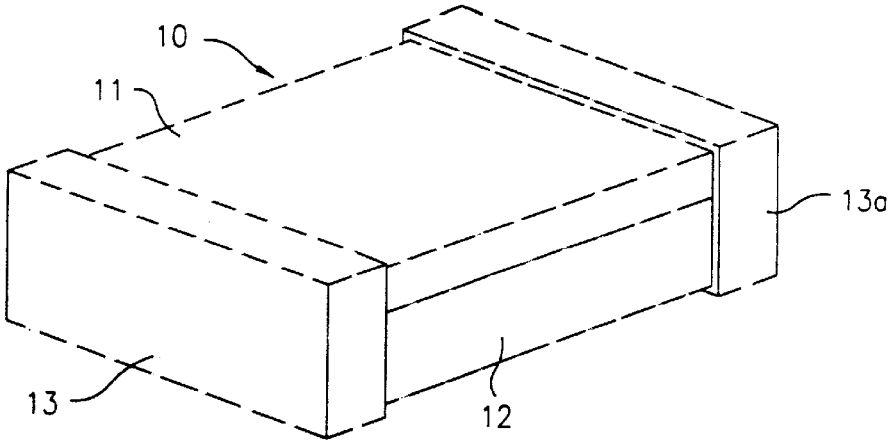
FIG. 4 is a perspective view illustrating a chip varistor according to another embodiment of the present invention.
Figure 5:
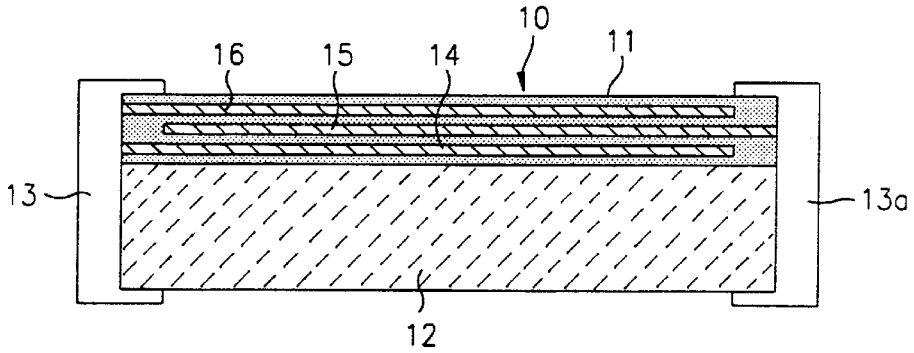
FIG. 5 is a vertical cross-sectional view illustrating the chip varistor of FIG. 4.

FIGS. 4 and 5 illustrates a chip varistor according to a second embodiment of the present invention. The construction of the second embodiment of the present invention is similar with the construction of the first embodiment of the present invention. In the second embodiment of the present invention, one surface of the varistor layer 11 is supported by the support layer 12. The varistor layer 11 of the chip varistor includes a varistor coating layer which is formed of a plurality of printed films, identically with the varistor later of FIG. 1.

Figure 6:
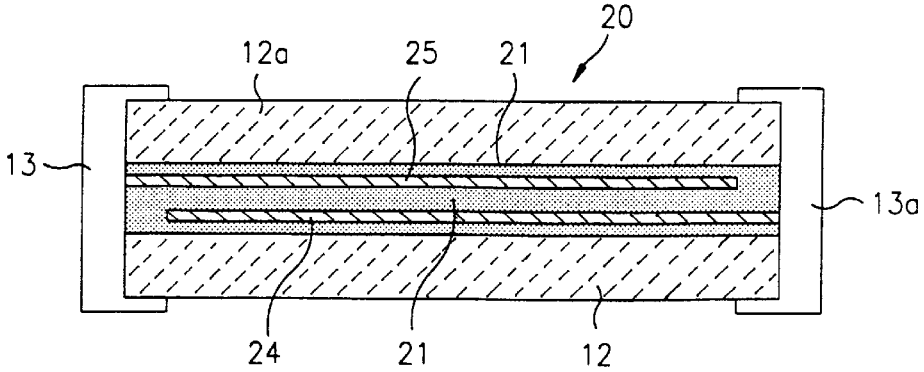
FIG. 6 is a vertical cross-sectional view illustrating a chip varistor according to still another embodiment of the present invention.

FIG. 6 illustrates a schematic cross-sectional view of the chip varistor according to a third embodiment of the present invention. As shown therein, in the chip varistor, the varistor layer 21 having internal electrodes 24 and 25 and being formed of a printed layer is supported by the support layers 12 and 12*a* at both sides, and the internal electrodes 24 and 25 are connected with the external electrodes 13 and 13*a* at both lateral surfaces of each stacked body 20. The varistor layer 21 of the chip varistor is longitudinally formed over the stacked body 20, and as shown in FIG. 7, the width of the varistor layer 21 is narrower than that of the stacked body, so that the varistor layer 21 is not exposed from both lateral surfaces of the stacked body 20.

Figure 7:
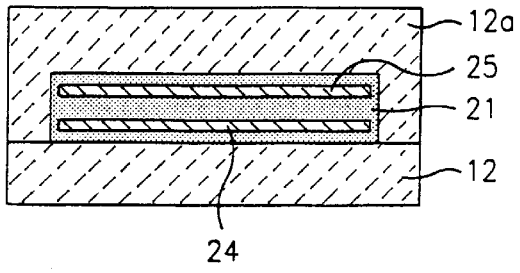
FIG. 7 is a horizontal cross-sectional view illustrating the chip varistor of FIG. 6.
Figure 8:
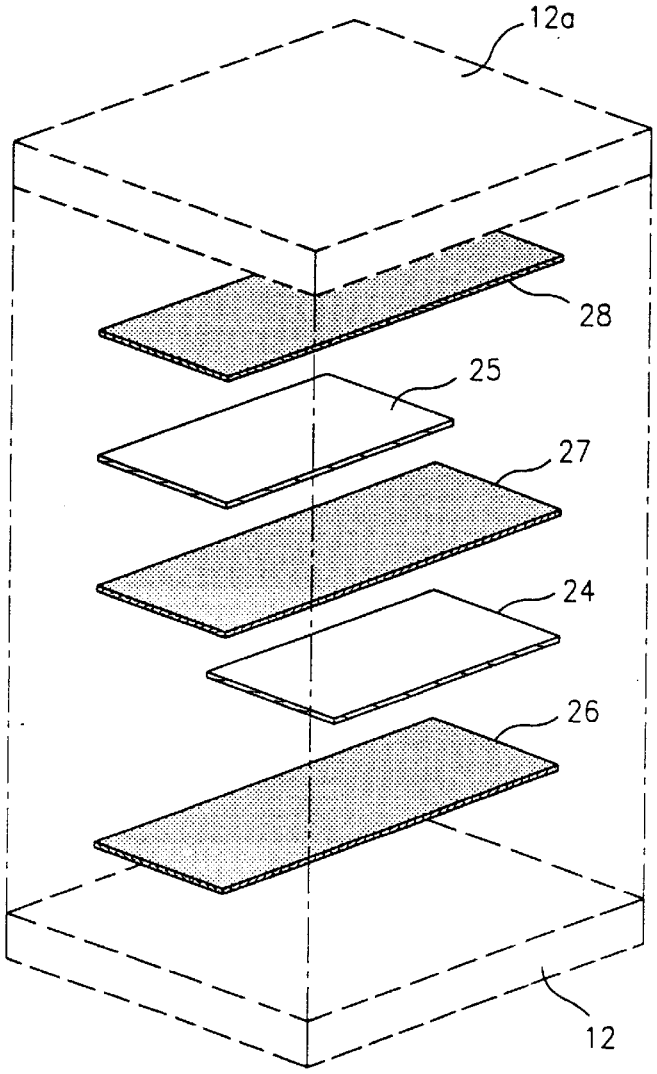
FIG. 8 is an exploded perspective view illustrating a stacked construction of the chip varistor of FIG. 6.

FIG. 8 is an exploded perspective view illustrating a fabrication process of the chip varistor stacked body 20 of FIGS. 6 and 7. As shown in FIG. 8, the stacked body 20 is formed of a support layer 12, a varistor coating layer 26 formed on the surface of the support layer 12 by a printing method, an internal electrode 24, a varistor coating layer 27 formed on the surfaces of the internal electrode 24 by the printing method, an internal electrode 25, a varistor coating layer 28 formed on the upper surface of the internal electrode 25 by the printing method, and an upper support layer. The above-described support layers 12 and 12*a*, the varistor coating layers 26, 27 and 28, and the internal electrodes 24 and 25 are sequentially stacked and are integrally sintered for thereby forming the structures of FIGS. 6 and 7. In the drawings, the support layers 12 and 12*a* and the varistor coating layers 26, 27 and 28 are shown to be separately formed for more understandably illustrating the construction of the same. Actually, the varistor layers and the support layers are integrally sintered.

Since the surface area of the externally exposed varistor layer is smaller than the occasion that the varistor layer is formed on the entire surface of the support area, the above-described varistor layer has a lower capacitance. In addition, since identical upper and lower support layers are engaged at both lateral portions, the engaging force is increased, which is much stronger than the occasion that the varistor layer is formed on the entire surfaces of the support layer.

Figure 9:
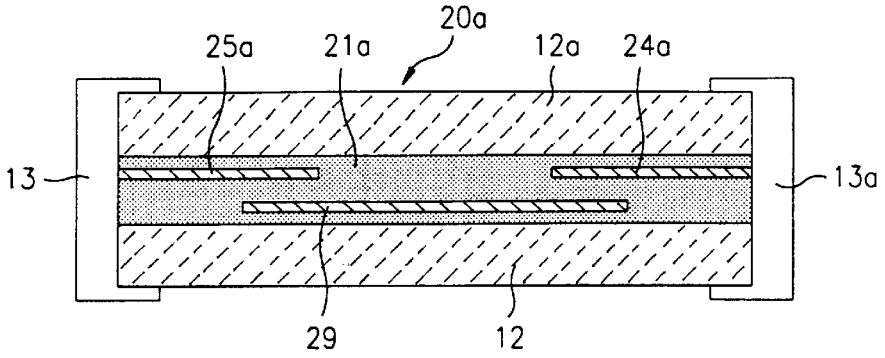
FIGS. 9 through 11 are vertical cross-sectional views illustrating chip varistors having a construction similar with the chip varistor of FIG. 6 and a different internal electrode, respectively.
Figure 10:
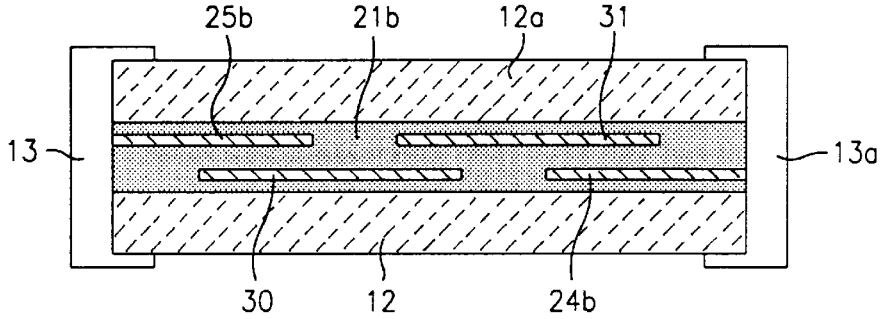
Figure 11:
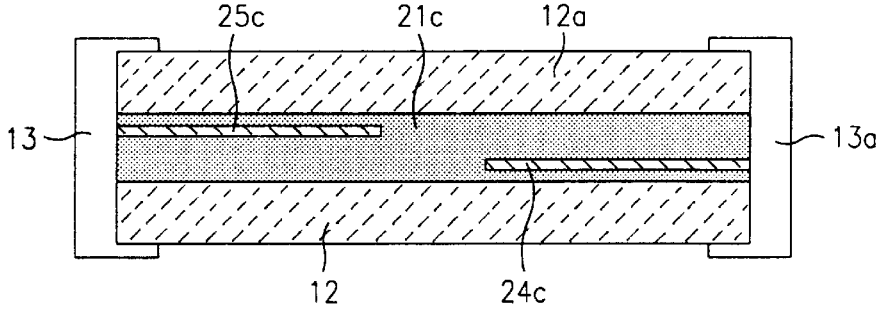

Same as FIGS. 6 through 8, the chip varistors shown in FIGS. 9 through 11 are formed of the varistor coating layer that the varistor layers 21*a*, 21*b* and 21*c* forming the stacked body 20*a* are formed by the printing method, but the shape of the internal electrodes is formed differently from the chip varistor s of FIGS. 6 through 8.

In the chip varistor of FIG. 9, the internal electrode 29 contiguous to the surface of the support layer 12 is not connected with the external electrodes, and the internal electrodes 24*a* and 25*a*, which are connected with the external electrodes, are formed on the identical surface and are not directly connected. The internal electrodes 24*a* and 25*a* are not directly connected with the internal electrode 29. Namely, the internal electrodes 24*a* and 25*a* are connected through the varistor layer 21*a*. In the above-described chip varistor, the varistor layer 21*a* and the internal electrodes 24*a*, 25*a* and 29 are formed by the printing method identically to the chip varistor of FIG. 6.

The chip varistor of FIG. 10 includes two internal electrodes 24*b* and 25*b* connected with the external electrodes which are separately formed in an upper and lower layer structure and two internal electrodes 30 and 31 which are not connected with the external electrode. The internal electrodes 24*b* and 25*b* connected with the external electrode and the internal electrodes 30 and 31 which are not connected with the external electrode are formed on the different surface.

The construction of the chip varistor of FIG. 11 is the same as the chip varistor of FIG. 6 except that the inner end portions of the internal electrodes connected with the external electrode are not stacked each other but are longitudinally spaced-apart at a regular interval.

FIGS. 12 through 16 illustrate a chip varistor according to another embodiment of the present invention in which the varistor layers 21*d*, 21*e*, 21*f* and 21*g* are not exposed to the outside. In the thusly constituted chip varistor, the varistor layers 21*d*, 21*e*, 21*f* and 21*g* are formed only on the inner portion of the varistor stacked body to be stacked with at least more than two internal electrodes 24*d*, 25*d*; 24*e*, 25*e*, 29*e*; 24*f*, 25*f*, 30*f*; 24*g*, 25*g*, 31*g*, so that the outer circumferential portions of the varistor layer are not exposed from the stacked body. The inner electrodes may be directly formed on the surface of the varistor layer or may be formed on the surface of the varistor layer formed on the surface of the support layer. However, a part of the internal electrode formed on the outer circumferential surface of the stacked body is directly formed on the support layer.

Figure 12:
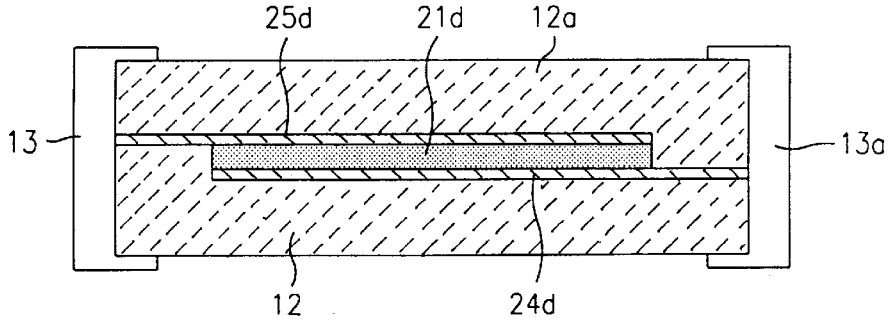
FIG. 12 is a vertical cross-sectional view illustrating a chip varistor according to still another embodiment of the present invention.
Figure 13:
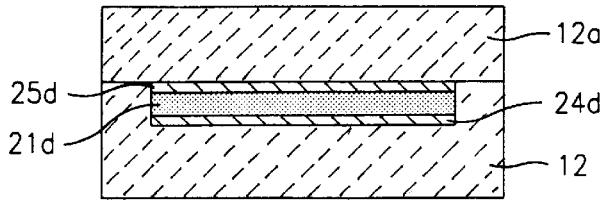
FIG. 13 is a horizontal cross-sectional view illustrating the chip varistor of FIG. 12.

As shown in FIGS. 12 and 13, the chip varistor includes a varistor layer 21*d* formed of stacked varistor coating layers, and internal electrodes 24*d* and 25*d* separately formed in the varistor layer in an upper and lower structure, and the internal electrode 24*d* is directly formed on the surface of the support layer 12, and the varistor layer 21*d* is not exposed from the lateral surface in which the external electrode is formed and the lateral surface in which the external electrode is not formed, respectively. In the above structure, since the varistor layer 21*d* is not directly connected with the external electrode in the outer circumferential surface of the stacked body 20*d*, it is possible to decrease the capacitance of the varistor.

Figure 14:
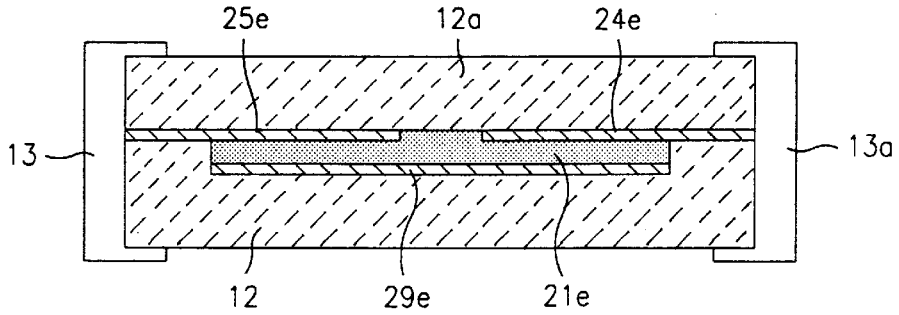
FIGS. 14 through 16 are vertical cross-sectional views illustrating a construction similar with the chip varistor of FIG. 13 and a different internal electrode, respectively.
Figure 15:
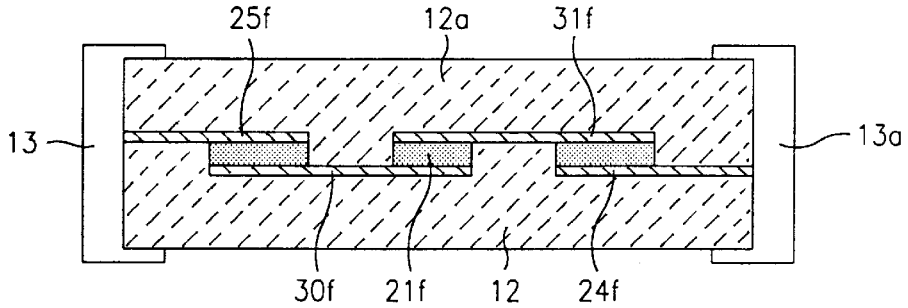
Figure 16:
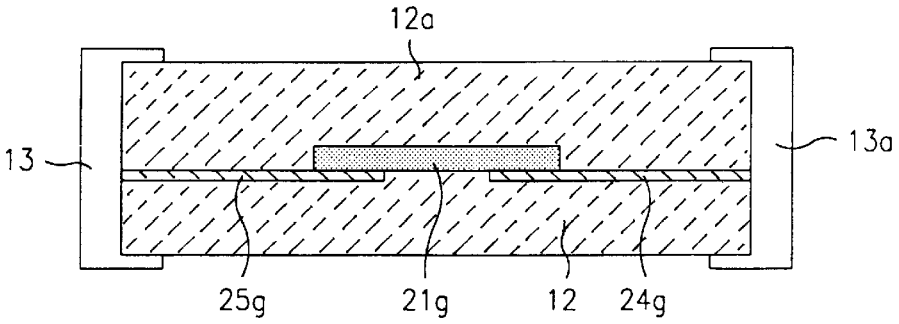

FIGS. 14 through 16 illustrate chip varistors having different types of electrodes in the chip varistor shown in FIG. 12. As shown in FIG. 14, the chip varistor includes an internal electrode 29*e* formed in the support layer 12 not to be connected with the external electrodes 13 and 13*a* and two internal electrodes 24*e* and 25*e* each having a predetermined height different from that of the internal electrode 29*e* and formed on the identical surface and connected with the external electrodes 13 and 13*a*.

As shown in FIG. 15, the chip varistor includes two internal electrodes 24*f* and 25*f* formed on the surface of the support layer 12 and two internal electrodes 30*f* and 31*f* each having a predetermined height different from those of the internal electrodes 24*f* and 25*f*. The first internal electrodes 24*f* and 25*f* are extended from both lateral surfaces of the stacked body and are connected with the external electrodes, 13, 13*a* and the second internal electrodes 30f and 31*f* are not directly connected with the external electrodes 13 and 13*a* and the internal electrodes 30*f* and 31*f*, respectively. In addition, in the portion in which the internal electrodes 24*f*, 25*f*, 30*f* and 31*f* are crossed, the varistor layer 21*f* is formed between the internal electrodes. The internal electrodes 24*f* and 25*f* connected with the external electrodes 13 and 13*a* are connected with each other through the varistor layer and the internal electrodes 30*f* and 31*f*. The varistor layer is formed of a plurality of varistor coating layers 21*f* spaced from one another in a direction extending between the external electrodes 13 as depicted in FIG. 15 on the lower portion of the support layer, the first support layer. The second support layer or top half of 12*a* encloses the varistor layers. At least two varistor coating layers 21*f* are connected only by a second internal electrode 30*f* or 31*f*.

As shown in FIG. 16, in the chip varistor, the internal electrodes 24*g* and 25*g* are formed on the surface of the support layer 12 to be extended from the lateral surfaces for being connected with the external electrode, and a varistor layer 21*g* is formed on the upper surface of the internal electrode to be folded with the end portions of the internal electrodes 24*g* and 25*g*.

In the above-described chip varistor, the varistor layer and the internal electrodes are formed of a coating layer by a coating method such as a silk screen printing method.

The fabrication of the chip varistor according to the present invention will now be explained with reference to the accompanying drawings.

A ceramic powder having a very low dielectric constant which is used for fabricating a ceramic electronic product is mixed with an organic binder such as PVA or PVB, and an alcohol such as a methanol which is an organic solvent is added with the resultant compound for thereby fabricating a slurry state compound. Thereafter, a support layer formed of a ceramic sheet on plurality thereof is formed by coating the resultant compound on a synthetic resin film such as a polyethylene film to a thickness of more than 0.1 mm as desired and dehydrating the same. A main member of 90~95 weight % selected from the group comprising ZnO, $BaTiO_3$, and $SrTiO_3$ is mixed with a varistor assistance material of 5~10 weight % such as $Bi_2O_3$, $Sb_2O_3$, $MnO_2$, etc., and an organic binder such as PVA or PVB is mixed with the resultant compound by 5% with respect to the entire weight of the varistor material. An organic solvent such as a topinol is added to the resultant compound and then the resultant compound is uniformly milled using the ball mill for thereby fabricating a paste or ink type empirical varistor compound. Thereafter, the empirical varistor compound is printed on the surface of the ceramic sheet forming the support layer to a thickness of 20$\mu$ through 1 mm by a silk screen printing method for thereby forming a first varistor coating layer, and a PtO slurry is printed on the upper surface of the varistor coating layer by the silk screen method for thereby forming a first internal electrode. Thereafter, a second varistor coating layer and a second internal electrode are sequentially formed on the upper surface of the first internal electrode by the above-described manner so that the internal electrodes are fully covered for thereby forming a varistor stack member. More preferably, an electrode protection varistor layer may be formed on the upper surface of the second internal electrode or the support layer may be formed by coating the varistor layer and stacking the ceramic sheet.

The resultant structure is sintered in an oven at a temperature of 800~1300° C. and then the external electrodes are formed on both lateral surfaces of the thusly fabricated varistor sintered body for thereby fabricating a chip varistor in which the varistor coating layers are integrally formed and reinforced by the ceramic support layer at one surface or both surfaces.

In the present invention, since the varistor layer is formed by the printing method, the thickness of the same is thin, so that the surface area contacting with the external electrodes is small, and thus the varistor has a small capacitance, and since the varistor layer is supported by the ceramic support layer having a lower dielectric constant, the strength of the same is increased, so that the varistor layer is not deformed or damaged when fabricating or handling the product.

In particular, in the present invention, since the varistor layer is formed as a coating layer by the printing method, the varistor layer is formed only in the support layer and is not laterally exposed from the stacked body having the external electrodes attached thereto. In the case that the varistor layer is formed only in the stacked body, since the varistor layer does not contact with the external electrode, it is possible to decrease the capacitance of the varistor. Particularly, in the chip varistor in which the varistor layer is formed only therein, when forming the support layer formed of the second ceramic sheet on the surface of the protection varistor layer formed on the highest internal electrode or the internal electrode, since the upper and lower ceramic sheets formed of the identical members at four circumferential portions of the stacked body are engaged, the engaging force of the stacked body is increased, so that the strength of the chip varistor is more enhanced compared to the engaging force of the same which is engaged through the varistor layer of the different component members.

EXAMPLE 1

A varistor material powder of 95 weight % composed of a ZnO powder 95 weight % and a 1:1 compound of 5 weight % of $Sb_2O_3$ and $Bi_2O_3$ is mixed with a polyvinyl alcohol 5 weight %, and a predetermined amount of topinol is added to the resultant compound, and then the resultant compound is milled using a ball mill for thereby fabricating an empirical varistor compound. The empirical varistor compound is printed on the ceramic sheet having a thickness of 1 mm by the silk screen printing method for thereby forming a first varistor coating layer to a thickness of $5\mu$, and then the first internal electrode formed of a PtO slurry is printed on the surface of the coating layer, and then the second varistor coating layer and the second internal electrode are printed on the surface of the resultant structure by the same manner. Thereafter, the protection varistor coating layer is formed on the surface of the resultant structure, and then the resultant structure is cut so that the first and second internal electrodes are exposed from both lateral surfaces for thereby forming the varistor stack member. The resultant structure is inserted into the oven and is sintered at a temperature of 900° C. and the external electrode slurry is coated on both lateral surfaces of the varistor sintered body from which the internal electrodes are exposed by the known method for thereby fabricating a chip varistor according to the present invention.

EXAMPLE 2

The example 2 is performed by a method similar with the example 1 except that the ceramic sheet is stacked on the surface of the internal electrode in which the protection varistor coating layer is not formed.

EXAMPLE 3

The example 3 is performed by a method similar with the example 2 except that $BaTiO_3$, not ZnO, is used as a varistor main member, and when the varistor coating layer is formed, the same is formed in a band type, and the resultant structure is cut so that the varistor layer is not exposed to both lateral surfaces on which the internal electrodes are not formed.

EXAMPLE 4

The example 4 is performed based on the example 2. In the example 4, $SrTiO_3$, not ZnO, is used. The varistor coating layer is formed in a quadrangle shape, and when cutting the resultant structure, it is cut at a portion in which the varistor coating layer is not formed so that the varistor layer is not exposed to the outside at four circumferential portions of the stacked body.

EXAMPLE 5

A first internal electrode is printed on the surface of the ceramic sheet having a thickness of 1.5 mm using the PtO slurry, and the empirical varistor of the example 1 is formed on the resultant structure to a thickness of $3\mu$ by the silk screen printing method for thereby forming a first varistor coating layer, and the second internal electrode and the protection varistor coating layer are separately printed on the surface of the coating layer in a quadrangle shape by the same method. The formed sheet is cut between the varistor layers so that the first and second internal electrodes are exposed from both lateral surfaces, and the varistor layer is not exposed to the outside for thereby forming the varistor stack member. The resultant structure is inserted into the oven and is sintered at a temperature of 900° C. and the external electrode slurry is coated on both lateral surfaces of the varistor sintered body from which the internal electrodes are exposed by the known method for thereby fabricating a chip varistor according to the present invention.

EXAMPLE 6

The varistor is formed by the example 1. At this time, the internal electrodes formed on the varistor layer is linearly formed.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. A low capacitance chip varistor having a capacitance lower than 10 pF, comprising:

at least one sheet type first support layer formed of a member having a low dielectric constant;

a varitor layer including a plurality of varistor coating layers formed on the first support layer;

a second support layer enclosing the varistor layer and having lateral surfaces separated from the varistor layer;

a plurality of first internal electrodes connected with the varistor layer, one end of each of which extends from the respective lateral surface of the second support layer; and a pair of integrally formed external electrodes formed on the lateral surfaces of said second support layer, the varistor layer being connected with another end portion of the first internal electrodes, the plurality of varistor coating layers being spaced from one another on the first support layer in a direction extending between the pair of external electrodes and second internal electrodes embedded within the support layers connecting said spaced plurality of varister coating layers to one another, at least two varistor coating layers connected only by one of the second internal electrodes.

2. The chip varistor of claim 1, wherein said sheet type first support layer is formed of a plurality of ceramic sheets.

3. The chip varistor of claim 1, wherein said varistor coating layers are formed by a printing method.

4. The chip varistor of claim 3, wherein said varistor coating layers are formed of a varistor material selected from the group comprising ZnO, $BaTiO_3$ and $SrTiO_3$ or is formed of a compound of ZnO, $BaTiO_3$ and $SrTiO_3$.

5. The chip varistor of claim 4, wherein said varistor coating layers are formed of an assistance material selected from the group comprising $Bi_2O_3$, $Sb_2O_3$, $MnO_2$, $Co_2O_3$, $Al_2O$, and PbO or an assistance material formed of a compound of $Bi_2O_3$, $Sb_2O_3$, $MnO_2$, $Co_2O_3$, $Al_2O$, and PbO including the above-mentioned varistor material.

* * * * *